US005425300A

United States Patent [19]

Ghisoni

[11] Patent Number: 5,425,300

[45] Date of Patent: Jun. 20, 1995

[54] MAGAZINE-TYPE FIREARM

[76] Inventor: Emilio Ghisoni, Via Villa Serafina 4, 27100 Pavia, Italy

[21] Appl. No.: 184,249

[22] Filed: Jan. 18, 1994

[30] Foreign Application Priority Data

Jan. 19, 1993 [IT] Italy ..... MI93A0062

[51] Int. Cl.[6] ..... F41A 5/04

[52] U.S. Cl. ..... 89/163

[58] Field of Search ..... 89/163, 170

[56] References Cited

U.S. PATENT DOCUMENTS 2,865,255 12/1958 Marsh ..... 89/163

5,317,951 6/1994 Reynolds ..... 89/163

FOREIGN PATENT DOCUMENTS 673028 5/1952 United Kingdom ..... 89/163

OTHER PUBLICATIONS

Hoffschmidt, E. J., "Beretta pocket pistol model 1934", NRA Illustrted Firearms Handbook, pp. 68–69.

*Primary Examiner*—Stephen C. Bentley

*Attorney, Agent, or Firm*—Herbert Dubno; Andrew Wilford

[57] ABSTRACT

A firearm has a frame, a magazine fitted in the frame and holding a plurality of cartridges including a top cartridge, a slide displaceable longitudinally on the frame above the magazine and its top cartridge along a longitudinal slide axis between a front position and a rear position, and a barrel centered on a barrel axis, displaceable longitudinally on the frame between respective front and rear positions, and having a rear end formed with a rearwardly open cartridge-receiving firing chamber. Pivot structure engaged between the barrel and the frame pivots the barrel on the frame between a firing position with the barrel axis substantially parallel to the slide axis and with the firing chamber transversely offset above the top cartridge and a loading position with the barrel axis forming an acute angle with the slide axis and with the firing chamber aligned longitudinally with and open downwardly toward the top cartridge. Cam structure between the barrel, frame, and slide pivots the barrel from its firing position to its loading position on displacement of the barrel and slide rearward out of their front positions and returns the barrel to its firing position on displacement of the barrel and slide forward back into their front positions.

12 Claims, 6 Drawing Sheets

MAGAZINE-TYPE FIREARM

FIELD OF THE INVENTION

The present invention relates to a firearm. More particularly this invention concerns a firearm which has a removable magazine or clip in which its cartridges are held.

BACKGROUND OF THE INVENTION

In a firearm of the automatic, semiautomatic or manual-repetition type having a magazine, when the cartridge moves from the magazine to the firing chamber it must execute a sort of jump entailing a change of position and orientation. The first cartridge of the magazine is aligned with an axis which is approximately parallel to the axis of the barrel, but somewhat lower. This allows a casing of a spent cartridge to be extracted from the firing chamber past the fresh cartridges below it in the clip. For this reason in the firearms of the known kind the cartridge following the spent and expelled one is pushed by the breech block or slide against an inclined surface whose purpose is to guide the fresh cartridge laterally to the firing chamber.

During this loading the cartridge is in effect almost wholly out of contact with the edges of the magazine and is not yet received and stabilized in the firing chamber. Thus this precariously held cartridge can get misaligned and jam the weapon with serious consequences for the user.

OBJECTS OF THE INVENTION

It is therefore an object of the present invention to provide an improved magazine-type firearm.

Another object is the provision of such an improved magazine-type firearm which overcomes the above-given disadvantages, that is which loads more smoothly than the prior-art systems so as to reduce the possibility of jamming.

SUMMARY OF THE INVENTION

A firearm has according to the invention a frame, a magazine fitted in the frame and holding a plurality of cartridges including a top cartridge, a slide displaceable longitudinally on the frame above the magazine and its top cartridge along a longitudinal slide axis between a front position and a rear position, and a barrel centered on a barrel axis, displaceable longitudinally on the frame between respective front and rear positions, and having a rear end formed with a rearwardly open cartridge-receiving firing chamber. In accordance with the invention pivot structure engaged between the barrel and the frame pivots the barrel on the frame between a firing position with the barrel axis substantially parallel to the slide axis and with the firing chamber transversely offset above the top cartridge and a loading position with the barrel axis forming an acute angle with the slide axis and with the firing chamber aligned longitudinally with and open downwardly toward the top cartridge. Cam structure between the barrel, frame, and slide pivots the barrel from its firing position to its loading position on displacement of the barrel and slide rearward out of their front positions and returns the barrel to its firing position on displacement of the barrel and slide forward back into their front positions.

Thus according to the instant invention the barrel is tipped down after the spent casing is ejected so that it is longitudinally aligned with the top cartridge in the clip. In this position the slide can push it straight into the firing chamber. The chance of the cartridge getting misaligned and jamming the action is virtually eliminated.

In accordance with a further feature of the invention the pivot further enables pivoting of the barrel on the frame into an ejecting position with the barrel axis forming an acute angle with the slide axis and with the firing chamber open upwardly away over the slide and away from the cartridge.

The barrel and slide are coupled together by formations for joint longitudinal movement and a stop is provided between the frame and the barrel for arresting the barrel in its rear position and for disengaging the formations from each other when the barrel moves back into its rear position so that the slide can continue to move backward to its rear position independently of the barrel. Thus the barrel and slide move back jointly from their front positions but after some travel the barrel is stopped and the slide continues, ejecting the spent cartridge. On the return movement of the slide it pushes the fresh cartridge into the rear end of the barrel, which meanwhile has been releasably arrested in its rear position, and then the barrel and slide together move forward to their front positions.

The pivot according to the invention includes a pivot pin journaled on the front end of the barrel or frame and longitudinally slidable in the front end of the frame or barrel, respectively. Normally the pin is on the front end of the barrel which is formed with a transversely throughgoing hole in which the pivot pin is journaled and the front end of the frame has a pair of confronting longitudinal slots in which ends of the pin are longitudinally slidable. The pivot system can also include a cam mounted on the barrel and a tipping element pivotal on the frame and engaged with the barrel and displaceable by the cam between a level position holding the barrel in the firing position and a tipped position holding the barrel in the loading position. This tipping element has a pair of laterally projecting follower pins sequentially engageable with the cam. In addition a spring-loaded ratchet engageable between the tipping element and the frame releasably retains the barrel in its firing and loading positions, and also in its ejecting position if necessary. The ratchet includes notches on the tipping element and a pawl pivotal on the frame and spring biased into engagement with the notches.

The slide according to the invention includes a pair of bars having front ends and a bridge interconnecting the front ends of the bars. The firearm further has a recoil spring braced between the bridge and the frame. The barrel itself has a rear end formed with a longitudinally forwardly open notch. The pivot including a pin seated in the frame and fitting in the forwardly open notch in the front position of the barrel.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2, 3, 4, 5:
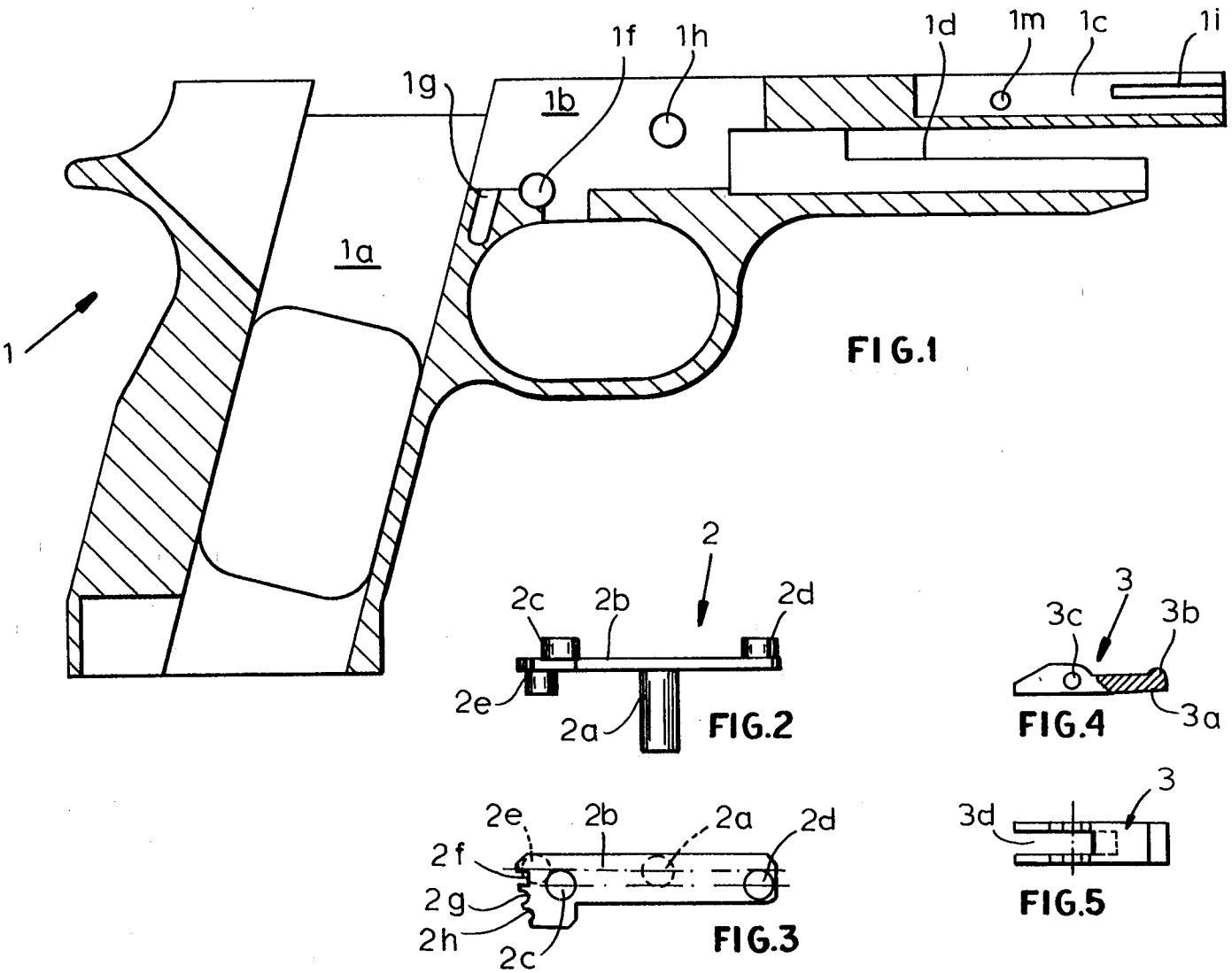
FIG. 1 is a vertical section through the frame of a pistol according to the invention.
FIG. 2 is a top view of the element for tipping the barrel of the pistol.
FIG. 3 is a side view of the element of FIG. 2.
FIG. 4 is a partly sectional side view of the barrel stop.
FIG. 5 is a top view of the FIG. 4 barrel stop.
Figure 6:
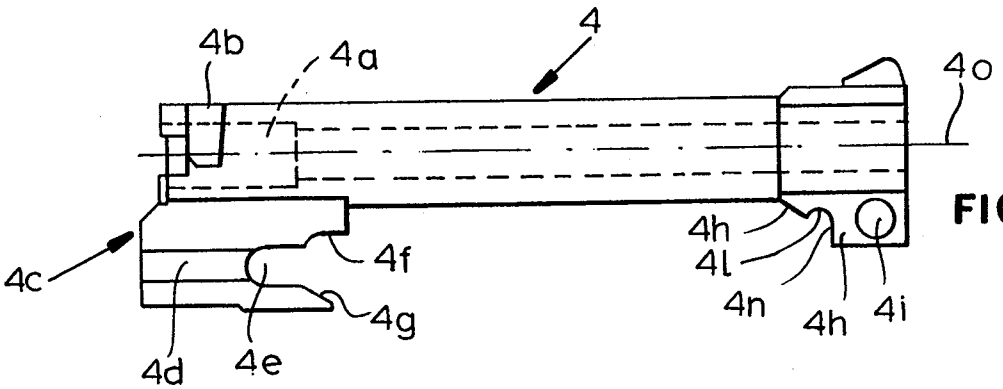
FIG. 6 is a side view of the pistol's barrel.
Figure 10:
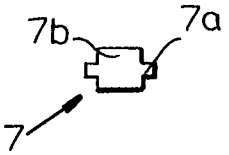
FIG. 10 is a front view of the barrel pivot element.
Figure 8:
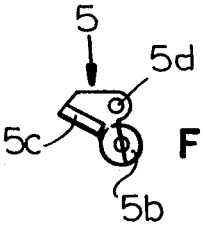
FIG. 8 is a side view of the latch pawl of the pistol.
Figure 9:
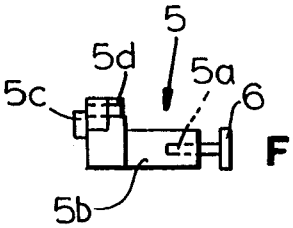
FIG. 9 is a front view of the FIG. 8 latch pawl.

As seen in FIGS. 1 through 11 where the parts—e.g. the trigger and hammer—responsible for firing are left out for clarity of view and because they are not relevant to the invention here—a firearm 50 has a frame 1 carrying a barrel 4 and a slide 8. The barrel 4 is mounted by a slide pivot 7 on the frame 1, and an actuator cam 8*h* (FIG. 7) integral with the slide 8 operates a tipping element 2 for the barrel 4 during gas-powered or manual displacement of this barrel 4 for reloading. This way an axis 4*o* of the barrel 4 is inclined downward with respect to an axis 8*o* of the slide 1 as shown for instance in FIG. 15, in order to eliminate the level differences between its firing chamber 4*a* and a first cartridge 9 of a magazine 11, in order to feed it into the chamber 4*a*.

In addition the pistol 50 is provided with a retaining element or stop 3 for holding the barrel 4 on the frame 1 when it is inclined. More specifically, the frame 1 has a chamber 1*a* in which the magazine 11 is held, an empty space 1*b* holding the rear end of the slide 8, and an empty space 1*c* holding the front end of the barrel 4. The frame 1 also has a forwardly open cutout or slot 1*d* whose rear end acts as a stop for a bridge 8*d* of the slide 8. In turn the empty space 1*b* is traversed by a hole 1*f* in which a pawl 5 is detained which acts upon notches 2*f*, 2*g*, and 2*h* on a rear extension of the tipping element 2 under the pressure of a spring 51 which is located in seat 1*g* of the frame 1. The empty space 1*c* has also a transverse hole 1*m* through which passes a pin 3*c* supporting the retaining element 3 that arrests the barrel 4 when it is retracted. A torque spring 3*e* on the pin 3*c* urges the head 3*b* of the element 3 upward. Guide slots 1*i* on the frame 1 receive the pivot 7 constituted as a small cylinder 7*b* which engages with small wings or gudgeons 7*a* in the guides 1*i*.

The tipping element 2 is a latch which supports the rear part of the barrel 4 via a cylindrical part 2*a* that fits in a pivot hole 1*h* of the frame 1 and that, in the front position of the barrel 4, fits in a slot 4*e* of this barrel 4. The tipping element 2 has a flat bar 2*b* which supports two buttons 2*c* and 2*d* that project laterally toward the outside of the weapon, while a small cam-follower cylinder 2*e* engages in a groove 4*d* of the barrel 4.

The retainer or stop 3 capable of blocking the barrel 4 in a preselected position via its front end 3*a* is provided with an upwardly directed rounded bump 3*b* that holds the barrel 4 in a retracted position under the pressure of the torsion spring 3*e* wound around the pin 3*c* and lodged in a rearwardly open cutout 3*d* of the element to define the rear position of the travel path for the barrel 4.

The barrel 4 is provided in its upper rear part above the firing chamber 4*a* with two symmetrically arranged mounting lugs 4*b* which can fit removably in corresponding seats 8*f* of the slide 8. The barrel 4 has a lower base 4*c* having on one side the groove 4*d* in which engages the small follower cylinder 2*e*. The base 4*c* is formed with the forwardly open slot 4*e* traversed by the cylindrical part 2*a* of the tipping element 2 during the firing phase and a recess 4*f* which on the contrary provides support to the cylindrical part 2*a* when a cartridge is introduced into the chamber 4*a*. In addition the base 2*c* has an inclined surface 4*g* which in the closing phase of the weapon engages with the cylindrical part 2*a* to tip the barrel 4 downward.

Figure 11:
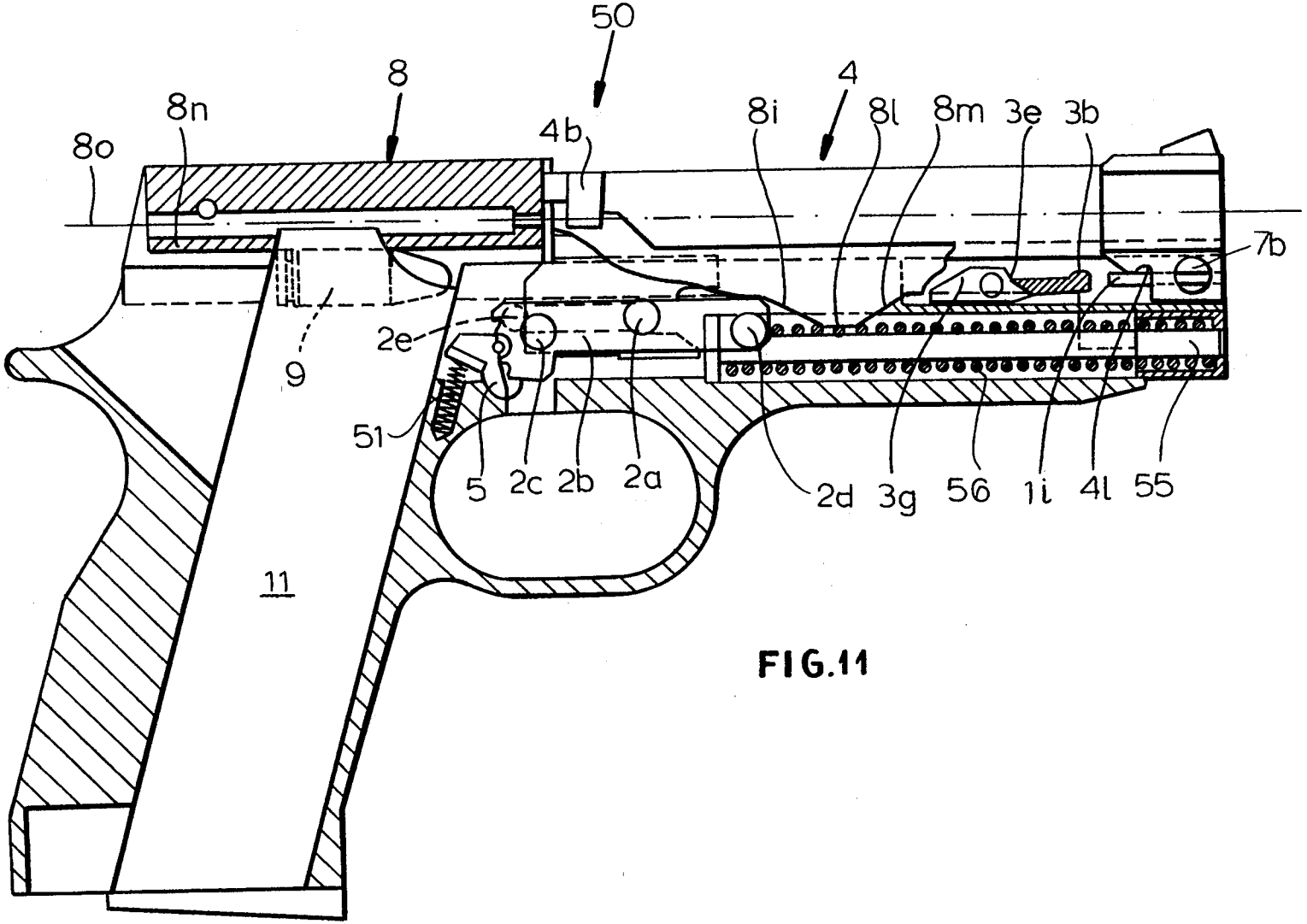
FIG. 11 is a vertical section through the fully assembled pistol in the loaded and ready-to-fire position.

The base 4*c* as visible in FIG. 11 fits in the empty space 1*b* while a front base 4*h* fits in the empty space 1*c* and has a hole 4*i* which accommodates the pivot or hinge 7 of the barrel 4. Rearward of the hole 4*i* on the barrel is a round downwardly open recess or seat 4*l* in which engages the rounded bump or head 3*b* of the retainer element 3.

An inclined camming surface 4*m* located rearward of the round recess 41 engages the rounded head 3*b* as the barrel 4 moves back, allowing its rear end to tip down. A rearwardly directed surface 4*n* can abut flatly against the front 3*a* and in this way can determine the stopping point for the barrel 4 during its rearward travel, that is its rear end position. The empty space 1*b* of the rear base 2*c* is formed with the hole if in which fits a cylindrical body 5*b* of the pawl 5. This pawl 5 also has an extension 5*c* which serves for manually operating a tempered pin 5*d* which engages in the notches 2*f*, 2*g* and 2*h* of the tipping element 2, retaining it in position during the various position changes of the barrel 4. Advantageously the pawl 5 is in turn retained on the frame 1 by the head of a screw 6 threaded into a laterally open bore 5*a* in this pawl 5.

The slide 8 has a body 8*a* longitudinally forwardly extended by two parallel bars 8*b* and 8*c* and, as already mentioned interconnected transversely in front by the bridge 8*d* which is formed with a longitudinal hole 8*e* through which passes a guide rod 55 for a recoil spring 56. Each strap 8*b* and 8*c* is formed with one of the seats 8*f* equipped with a rearwardly directed stop surface 8*g* on whose inside engages the respective mounting lug 4*b*.

Figure 7:
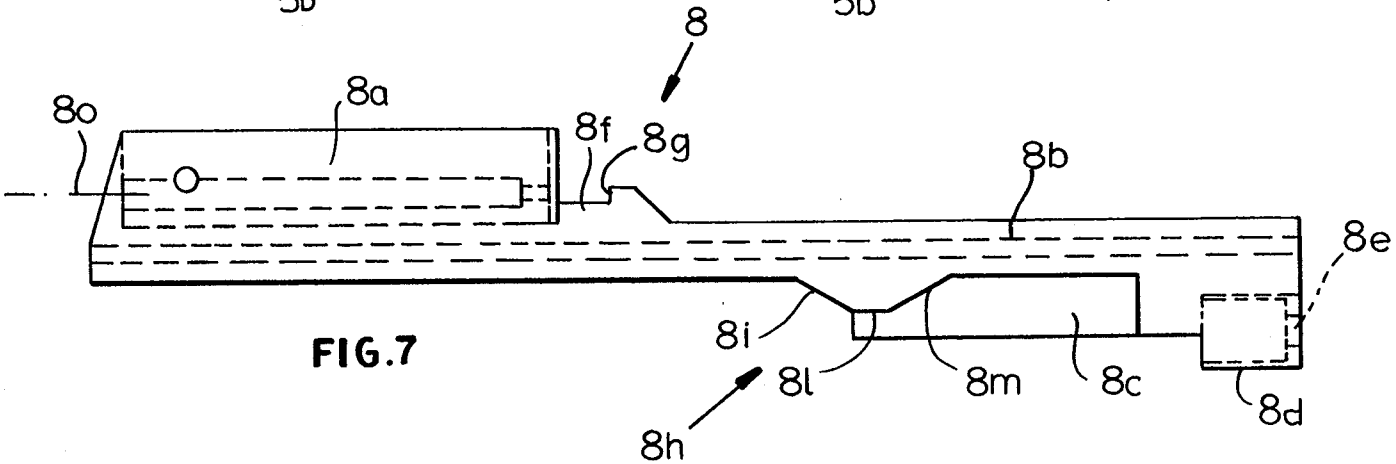
FIG. 7 is a side view of the pistol's slide.

The strap 8*b* on the right side of the tipping element 2 has the actuator cam 8*h* which as seen in FIG. 7 is formed with inclined camming surfaces 8*i* and 8*m* interconnected by a longitudinal surface 81.

The above-described semiautomatic short-stroke pistol operates as follows:

To start with the various parts are in the position of FIG. 11, ready to fire. The barrel 4 and the slide 8 are positioned fully forward and the barrel 4 is supported at its front end by the small cylinder 7*b* lodged within the hole 4*i* and at its rear end by the pin 2*a* of the tipping element 2 lodged in the forwardly open slot 4*e*. The mounting lugs 4*b* fit inside the seats 8*f*, engaging forward against the surfaces 8*g* so that the barrel 4 cannot move longitudinally relative to the slide 8. The axis 4*o* of the barrel 4 is parallel to or coincident with the axis 8*o* of the slide 8 and the cartridge 9 is firmly pressed by a rear end 8*n* of the slide 8 against the bottom of the slide 8 into a position which is clearly lower than the axis 4*o* of the barrel 4. The contact button 2*d* is at a spacing of a few millimeters behind the inclined surface 8*i*. The pawl 5 engages the button 5*d* in the center notch 2*g* and the flat bar 2*b* of the element 2 is also horizontal.

Figure 12:
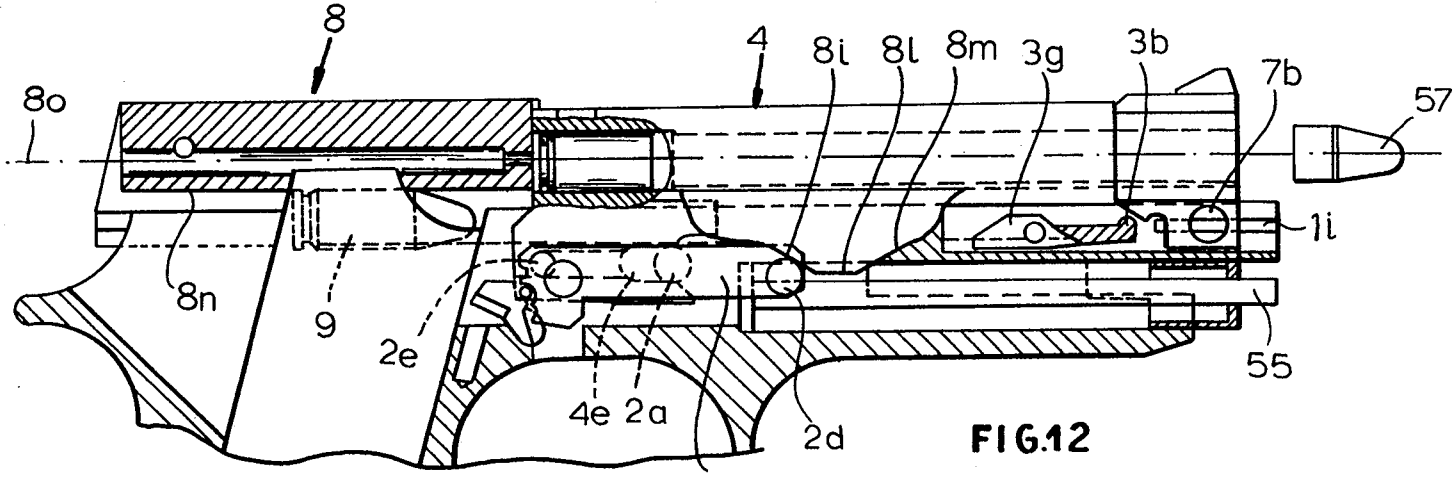
FIGS. 12, 13, 14, 15, 16, and 17 are sections like FIG. 11 of the pistol as it is fired and in the succeeding positions as it reloads, the position of FIG. 17 corresponding to the position the pistol assumes just before returning to the position of FIG. 11.

In the second phase shown in FIG. 12 the pistol has been fired and a slug 57 has left the barrel 4 which itself starts to move longitudinally straight back, supported by the cylindrical element 2*a* and the small cylinder 7*b*. The contact button 2*d* engages the inclined surface 8*i* of the cam 8*h*.

Figure 13:
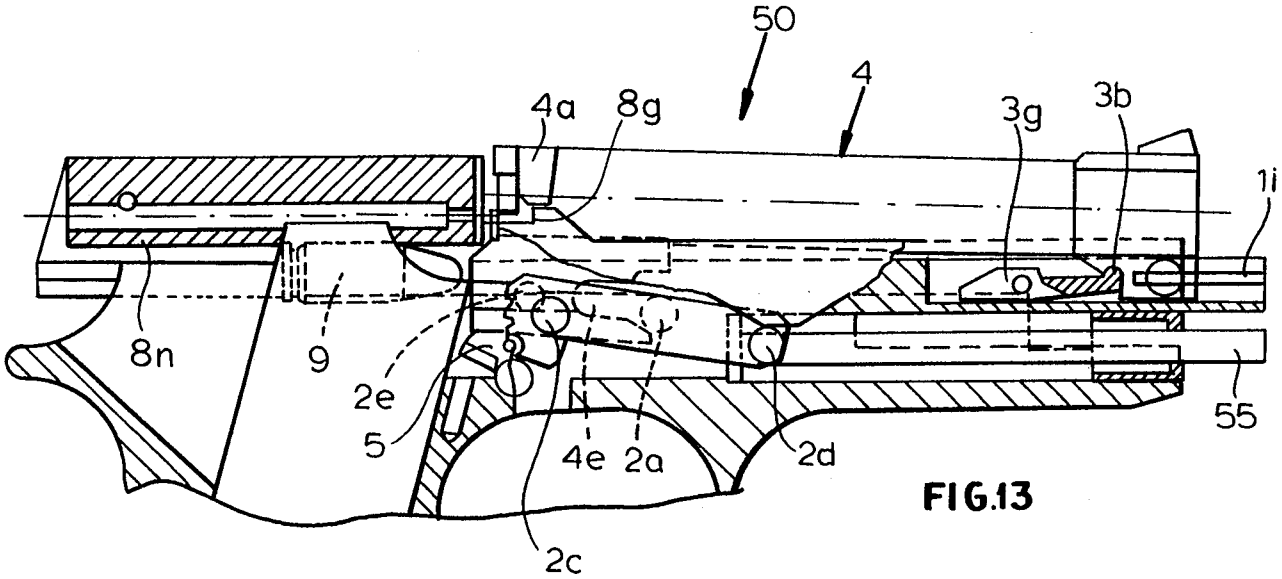

In the third phase, represented in FIG. 13, the rearward travel continues due to the inertia of the barrel-slide subassembly. The inclined surface 8*i* pushes the contact button 2*d* down, thereby tipping down the front end of the bar 2*b* and tipping up its rear end. The small cylinder 2*e* lodged in the groove 4*d* then pushes the barrel 4 up after the cylindrical element 2*a* has moved forwardly out of the forwardly open elongated slot 4*e*, overcoming the resistance of the pawl 5 whose pin 5*d* now moves into the lower notch 2*h*. This leaves the barrel 4 in a tipped-up ejecting position with its axis 4*o* inclined upward and back, forming a small acute angle with the slide axis 8*o*. The barrel 4 stops in its rear end position against the front 3*a* of the element 3 and the rounded head 3*b* engages in the round seat 4*l* to maintain the barrel 4 in this rear end position. The two mounting lugs 4*b* have meanwhile been pushed up to disengage the stops 8*g* and the slide 8, now disengaged from the barrel 4 which is stopped, continues its rearward travel due to inertia.

Figure 14:
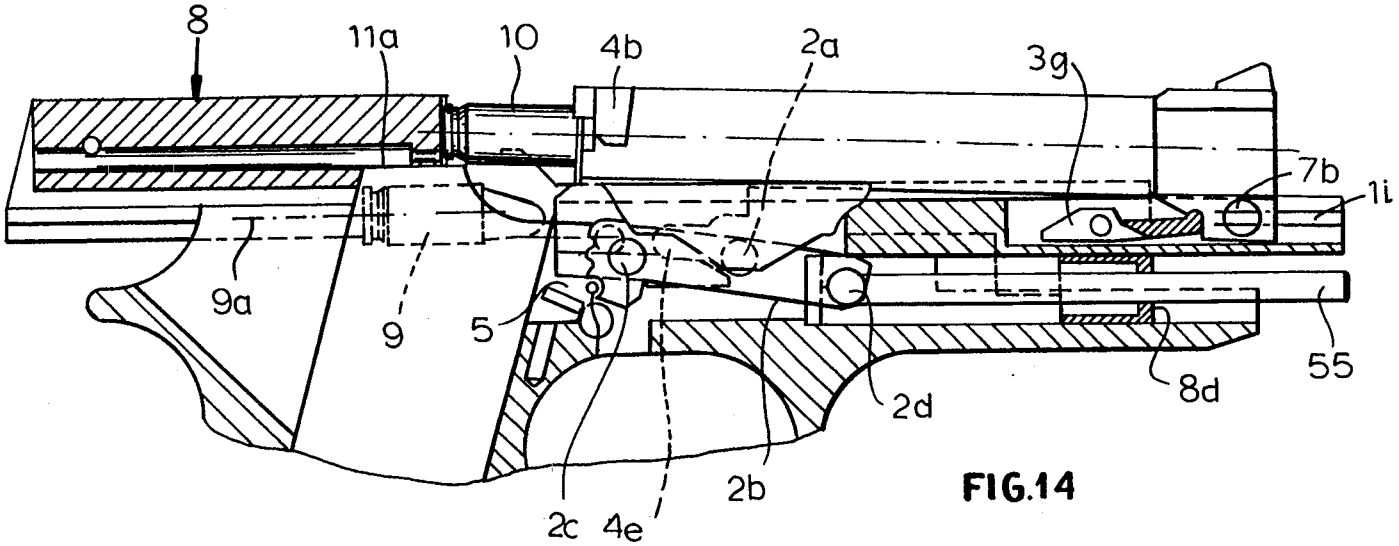

In the fourth phase illustrated in FIG. 14 the slide 8 extracts the cartridge casing 10 which subsequently is expelled laterally in the manner well known in the art. All other elements of the system are in exactly the same position as in the preceding phase of FIG. 13. The raising of the rear part of the barrel 4 has allowed the cartridge casing 10 of the spent cartridge to pass over the upper side edges 11*a* of the magazine 11. The inclined surface 8*i* is now located in the vicinity of the contact button 2*c*. Meanwhile the unillustrated follower in the clip 11 pushes the cartridges therein upward so the uppermost cartridge 9 assumes a position with its axis 9*a* directed somewhat upward.

Figure 15:
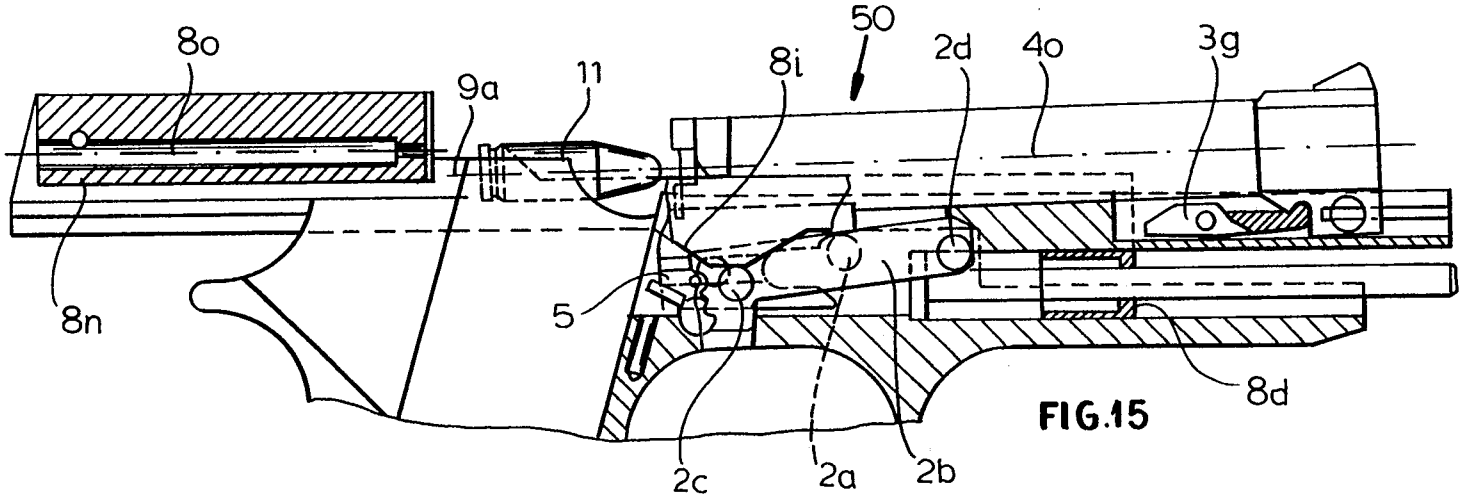

In the fifth phase shown in FIG. 15, the inclined surface 8*i* has pushed down the rear of the barrel 4 via the element 2 which is maintained in this position as the pawl 5 ratchets the pin 5*d* into the upper notch 2*f*. The recess 4*f* of the base 4*c* of the barrel 4 in this position is supported on the cylindrical part 2*a*. The axis 4*o* of the barrel 4*o* in this tipped-down position coincides substantially with the axis 9*a* of the uppermost cartridge 9 and is inclined rearward and down, again forming a small acute angle with the slide axis 8*o*. The uppermost cartridge 9 is no longer held down by the rear part 8*n* of the slide 8 but is now only held back by the edges 11*a* of the magazine 11.

Thus according to the invention the level discrepancy between the firing chamber 4*a* and the first cartridge 9 in the magazine 11 is eliminated and in fact the axis 9*a* of the top cartridge 9 and the axis 4*o* of the barrel are coaxial. This largely eliminates the possibility of any type of jamming of the weapon.

Figure 16:
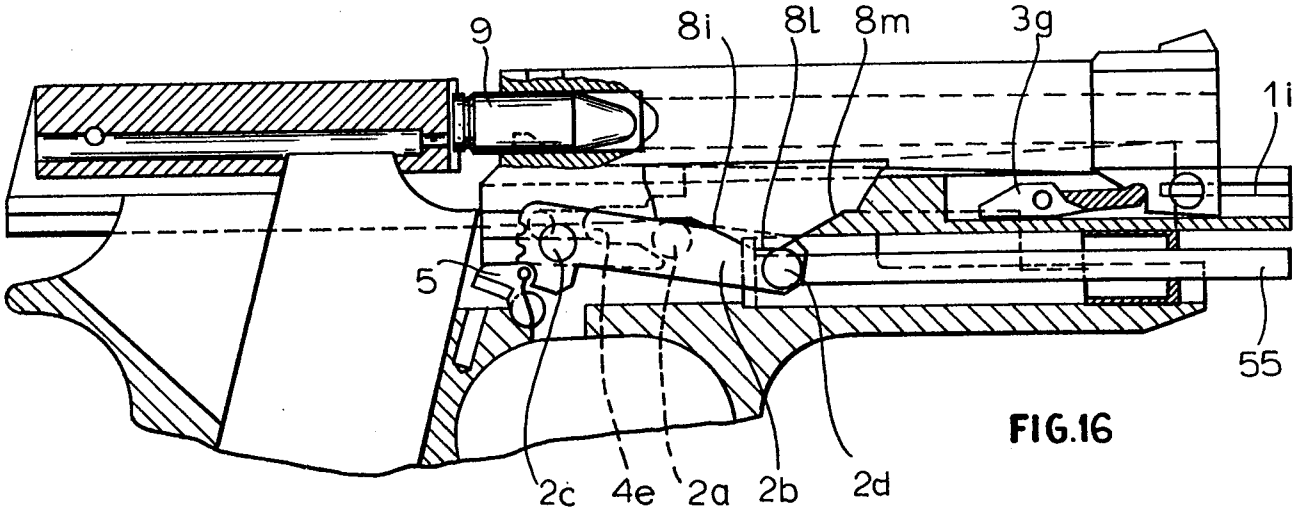
Figure 17:
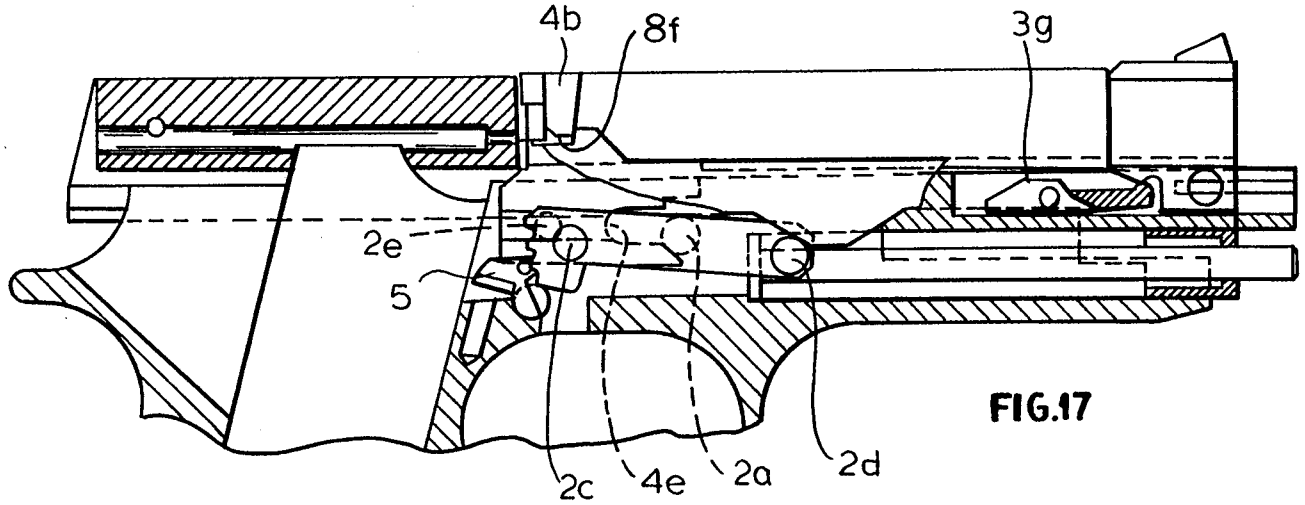

Subsequently as shown in FIG. 16 the slide 8 is pushed forward by the recoil spring 56 to push the cartridge 9 into the firing chamber 4*a* as the cam 8*h* moves forward, it pushes down the follower cylinder 2*d* and thereby raises the rear end of the element 2 to a momentarily raised position, with the pin 5*d* in the upper notch 2*f*, then finally firmly positioning the pin 5*d* in the middle notch 2*g* with the axes 4*o* and 8*o* aligned.

It has been found that in practice the firearm with magazine according to the invention has proven to be especially advantageous due to the substantial alignment of the barrel 4 with the first cartridge 9 of the magazine 11 during the phase of its introduction in the chamber 4*a*. This is so because it eliminates the level discrepancy existing between the firing chamber and the first cartridge, eliminating this way completely the most frequent inconvenience in this known type of arms which is the jamming of the firearm.

Furthermore, in spite of the tilting of the barrel 4, the firearm which is the object of the present invention has also an optimal firing precision because at the moment when it is fired it is supported at both its front and rear ends 4*h* and 4*c* on the frame 1.

As already mentioned as an example a semiautomatic pistol with short recoil is illustrated, because this type of weapon has the most complex way of functioning, but the proposed solution can be applied to any type of long or short weapon, be it automatic, semiautomatic or with manual repetition, with a tilting or fixed barrel, a machine gun or the like. The invention conceived this way can be subjected to numerous modifications and variations, all being within the scope of the inventive concept. Any such details can be substituted by elements which are technically equivalent. In practice the materials used as well as the dimensions can be selected as desired, according to the requirements and the state of the art.

I claim:

1. A firearm comprising:

a frame having a front end;

a magazine fitted in the frame and holding a plurality of cartridges including a top cartridge;

a slide displaceable longitudinally on the frame above the magazine and its top cartridge along a longitudinal slide axis between a front position and a rear position;

a barrel centered on a barrel axis, displaceable longitudinally on the frame between respective front and rear positions, and having a rear end formed with a rearwardly open cartridge-receiving firing chamber and a front end;

pivot means including a pivot pin journaled in one of the front ends and longitudinally slidable in the other front end for pivoting of the barrel of the frame between a firing position with the barrel axis substantially parallel to the slide axis and with the firing chamber transversely offset above the top cartridge, and a loading position with the barrel axis forming an acute angle with the slide axis and with the firing chamber aligned longitudinally with and open downwardly toward the top cartridge; and cam means between the barrel, frame, and slide for pivoting the barrel between form its firing position to its loading position on displacement of the barrel and slide rearward out of their front positions and for returning the barrel to its firing position on displacement of the barrel and slide forward back into their front positions.

2. The firearm defined in claim 1, further comprising:

formations coupling the barrel and slide together for joint longitudinal movement; and stop means between the frame and the barrel for arresting the barrel in its rear position and for disengaging the formations from each other when the barrel moves back into its rear position, whereby the slide can continue to move backward to its rear position independently of the barrel.

3. The firearm defined in claim 1 wherein the one front end is the front end of the barrel.

4. The firearm defined in claim 3 wherein the front end of the barrel is formed with a transversely throughgoing hole in which the pivot pin is journaled and the front end of the frame has a pair of confronting longitudinal slots in which ends of the pin are longitudinally slidable.

5. The firearm defined in claim 1 wherein the pivot means further includes:

a cam mounted on the slide; and a tipping element pivotal on the frame and engaged with the barrel and displaceable by the cam between a level position holding the barrel in the firing position and a tipped position holding the barrel in the loading position.

6. The firearm defined in claim 5, further comprising means including a spring-loaded ratchet engageable between the tipping element and the frame for releasably retaining the barrel in its firing and loading positions.

7. The firearm defined in claim 6 wherein the ratchet includes notches on the tipping element and a pawl pivotal on the frame and spring biased into engagement with the notches.

8. The firearm defined in claim 1 wherein the slide includes a pair of bars having front ends and a bridge interconnecting the front ends of the bars, the firearm further comprising a recoil spring braced between the bridge and the frame.

9. A firearm comprising:

a frame;

a magazine fitted in the frame and holding a plurality of cartridges including a top cartridge;

a slide displaceable longitudinally on the frame above the magazine and its top cartridge along a longitudinal slide axis between a front position and a rear position;

a barrel centered on a barrel axis, displaceable longitudinally on the frame between respective front and rear positions, and having a rear end formed with a rearwardly open cartridge-receiving firing chamber;

pivot means engaged between the barrel and the frame for pivoting of the barrel on the frame between a firing position with the barrel axis substantially parallel to the slide axis and with the firing chamber transversely offset above the top cartridge, a loading position with the barrel axis forming an acute angle with the slide axis and with the firing chamber aligned longitudinally with and open downwardly toward the top cartridge, and an ejecting position with the barrel axis forming an acute angle with the slide axis and with the firing chamber open upwardly away over the slide and away from the cartridge; and cam means between the barrel, frame, and slide for pivoting the barrel between from its firing position to its loading position on displacement of the barrel and slide rearward out of their front positions and for returning the barrel to its firing position on displacement of the barrel and slide forward back into their front positions.

10. The firearm defined in claim 9 wherein the frame and barrel each have a front end and the pivot means includes a pivot pin journaled on one of the front ends and longitudinally slidable in the other front end.

11. A firearm comprising:

a frame;

a magazine fitted in the frame and holding a plurality of cartridges including a top cartridge;

a slide displaceable longitudinally on the frame above the magazine and its top cartridge along a longitudinal slide axis between a front position and a rear position;

a barrel centered on a barrel axis, displaceable longitudinally on the frame between respective front and rear positions, and having a rear end formed with a rearwardly open cartridge-receiving firing chamber;

pivot means engaged between the barrel and the frame for pivoting of the barrel on the frame between a firing position with the barrel axis substantially parallel to the slide axis and with the firing chamber transversely offset above the top cartridge, and a loading position with the barrel axis forming an acute angle with the slide axis and with the firing chamber aligned longitudinally with and open downwardly toward the top cartridge; and cam means between the barrel, frame, and slide for pivoting the barrel between from its firing position to its loading position on displacement of the barrel and slide rearward out of their front positions and for returning the barrel to its firing position on displacement of the barrel and slide forward back into their front positions;

a cam mounted on the slide; and a tipping element pivotal on the frame and engaged with the barrel and displaceable by the cam between a level position holding the barrel in the firing position and a tipped position holding the barrel in the loading position, the tipping element having a pair of laterally projecting follower pins sequentially engageable with the cam.

12. A firearm comprising:

a frame;

a magazine fitted in the frame and holding a plurality of cartridges including a top cartridge;

a slide displaceable longitudinally on the frame above the magazine and its top cartridge along a longitudinal slide axis between a front position and a rear position;

a barrel centered on a barrel axis, displaceable longitudinally on the frame between respective front and rear positions, and having a rear end formed with a rearwardly open cartridge-receiving firing chamber and with a longitudinally forwardly open notch;

pivot means including a pin seated in the frame and fitting in the forwardly open notch in the front position of the barrel for pivoting of the barrel on the frame between a firing position with the barrel axis substantially parallel to the slide axis and with the firing chamber transversely offset above the top cartridge, and a loading position with the barrel axis forming an acute angle with the slide axis and with the firing chamber aligned longitudinally with and open downwardly toward the top cartridge; and cam means between the barrel, frame, and slide for pivoting the barrel between from its firing position to its loading position on displacement of the barrel and slide rearward out of their front positions and for returning the barrel to its firing position on displacement of the barrel and slide forward back into their front positions.

* * * * *